US005217063A

United States Patent [19]

Scaringe et al.

[11] Patent Number: 5,217,063

[45] Date of Patent: Jun. 8, 1993

[54] THERMAL STORAGE HEAT PIPE

[75] Inventors: Robert P. Scaringe, Rockledge; Lawrence R. Grzyll, Merritt Island; Clyde F. Parrish, Melbourne, all of Fla.

[73] Assignee: Mainstream Engineering Corporation, Rockledge, Fla.

[21] Appl. No.: 886,256

[22] Filed: May 21, 1992

[51] Int. Cl.[5] ..... F28D 15/02

[52] U.S. Cl. ..... 165/32; 165/104.27; 165/134.1

[58] Field of Search ..... 165/32, 96, 104.26, 165/104.27, 134.1

[56] References Cited

FOREIGN PATENT DOCUMENTS 35822 3/1980 Japan ..... 165/32

59191 5/1981 Japan ..... 165/32

*Primary Examiner*—Albert W. Davis, Jr.

*Attorney, Agent, or Firm*—Evenson, McKeown, Edwards & Lenahan

[57] ABSTRACT

A thermal storage heat pipe apparatus and method uses an adsorption chamber connected with the condenser section of a heat pipe via a valve which opens in response to selected changes in temperature and pressure in the heat pipe. The apparatus and method provides adequate heat pipe operation, in addition to normal operation, during frozen startup, when there is no condenser heat rejection and when the evaporator cooling requirements exceed the condenser heat rejection capacity. In addition, the apparatus and method permit recharging and avoids frozen heat pipes where, for example, water is used as the working fluid.

13 Claims, 2 Drawing Sheets

THERMAL STORAGE HEAT PIPE

BACKGROUND AND SUMMARY OF THE INVENTION

The present invention relates to a heat pipe and method that incorporates thermal storage within the heat pipe and eliminates problems associated with incongruent melting, poor thermal conductivity, and the like. More particularly, the present invention is directed to a heat pipe which uses vapor-solid thermal storage of the excess heat pipe working fluid vapor within the heat pipe itself. Because the thermal storage is integrated into the heat pipe and uses the heat pipe working fluid, the thermal storage system is compact and lightweight.

A basic problem with all satellites is the problem of heat rejection. The problem is compounded in low earth orbit satellites where the effective space temperature for radiation heat transfer is quite high (typically 227K), thus requiring in relatively large thermal radiators. For all satellites, however, the problem is complicated by the lack of available surface area and/or the necessary radiation size of the radiators.

One solution used in high power satellites has been the use of a heat pump to elevate the radiation rejection temperature and thereby reduce the area of the thermal radiator. Although this approach works for all size satellites, the mass and area reductions are greater for high-power satellites. Heat pumps may also have some beneficial applications in smaller satellites, but typically these small satellites have accomplished their heat rejection requirements with a passive heat rejection system. As a matter of fact, the use of an active system is perceived as a major drawback in small satellites.

Cyclic thermal loads on the spacecraft thermal control system require that the thermal control system be sized for the maximum thermal load or that thermal storage to average the thermal load uniformly over the entire orbital cycle be utilized. Spacecraft applications have other restrictions, which include minimal system mass and system volume, and long-term reliability. Although it is not desirable to increase the size/capacity of the thermal control system, to accommodate the peak thermal load, up to now this has been the only effective technique available, especially in very small satellites in which the thermal storage structure and control system may be a significant fraction of the entire thermal storage device.

Current thermal storage devices also suffer from long-term performance problems. For example, phase change materials exhibit incongruent melting, poor thermal conductivity in the solid phase, and problems with resolidification. Metal hydrides are heavy and they compact due to fragmentation on repeated cycling. Sensible heat storage is too large and heavy.

Spacecraft applications, which have cyclic thermal loads that must be rejected to space through a radiator system, thus present a major problem. The typical spacecraft system is very mass-and-radiator-area sensitive and, at the same time, suffers from large thermal spikes which are many times the base load. Currently, no thermal storage system has provided a reliable, repeatable, compact storage system for small satellites.

When heat pipe transport capacity is insufficient (i.e., during increased evaporator cooling demands or with reduced condenser rejection capability), the heat pipe temperature and pressure normally rise due to the increased generation of vapor in the evaporator or the reduced condensation of vapor in the condenser. This excess vapor needs to be absorbed or swept away in some manner, or the pressure and temperature in the heat pipe will continue to rise, resulting in undesired increased heat pipe operating temperatures which will damage the equipment being cooled or at least severely decease their service life.

It is an object of the present invention to solve thermal problems associated with low-power, small satellites whose duty cycle is such that thermal storage reduces radiator requirements in light of the fact that the thermal rejection requirements are currently not uniformly spread over the entire orbital time.

It is yet another object of the present invention to provide a thermal storage heat pump and method for small satellites utilizing a passive, thermal storage heat pipe, i.e., a heat pipe that behaves as an ordinary heat pipe but can also store a significant amount of energy within the pipe in those instances when the heat load exceeds the heat rejection capability of the thermal radiators.

It is still a further object of the present invention to provide a heat pump which has other applications, including the addition of thermal storage within a hardened radiator assembly, by using the thermal storage heat pipes instead of conventional heat pipes to distribute the energy to individual radiator sections.

The foregoing objects have been achieved in accordance with the present invention by using a heat pipe thermal method and system with an adsorption chamber connected to the vapor space of the heat pipe. This chamber contains an absorbent for the heat pipe working fluid that can adsorb the heat pipe vapor.

In the present invention, a slight increase in pressure or temperature, the actual amount being a system variable, will cause a pressure- or temperature-actuated valve to open, allowing the vapor to flow into an adiabatic adsorption chamber where the vapor is adsorbed by the adsorbent material. The heat pipe continues to cool because the evaporator continues to evaporate liquid. The resulting vapor flows into this chamber to be adsorbed. The liquid to be evaporated is supplied from the liquid located in liquid artery and condenser sections of the heat pipe. The process continues until the heat pipe is depleted of liquid or the vapor adsorption chamber is saturated. The heat pipe can be configured so that these two events occur simultaneously, or the adsorption chamber can saturate first, allowing the thermal storage heat pipe to continue to function as an ordinary heat pipe after the adsorption chamber is saturated.

The adsorption chamber is later discharged when the condenser capacity exceeds the evaporator load. This thermal storage heat pipe thus has only one moving part, namely a pressure or temperature-actuated valve configured, for example, as a spring-loaded pressure or bimetallic thermal valve.

Inasmuch as adequate data is not available for the rate at which working fluid is adsorbed on an adiabatic adsorption bed, simple adsorption experiments verify that the adsorption and desorption for the present invention is rapid enough for spacecraft thermal control applications. These experiments were performed for the adsorption and desorption of methanol on a molecular sieve. FIG. 1 illustrates how rapidly the working fluid is adsorbed or desorbed from the adsorbent materia. In the adsorption experiment, the refrigerant i.e., methanol, was added to one cylinder. The system was evacuated and the valve between the refrigerant and the adsorbent opened. The methanol vapor flowed from the first cylinder, which simulated the heat pipe vapor core, and was adsorbed on the molecular sieves in the other cylinder. The temperature, weight, and pressure were monitored. The quantity of working fluid adsorbed appears consistent with the available commercial sieve data.

A number of different refrigerant working fluids are contemplated along with a number of adsorbent materials to provide significant thermal storage capacity within a heat pipe. One exemplary system uses water as the refrigerant and a molecular sieve as the adsorbent material. A significant thermal storage capability is thereby achieved. The method of the present invention can be used, however, with any heat pipe working fluid, except possibly the liquid metal heat pipes.

BRIEF DESCRIPTION OF THE DRAWINGS

These and further objects, features and advantages of the present invention will become more apparent from the following detailed description of a currently preferred embodiment when taken in conjunction with the accompanying drawings wherein.

DETAILED DESCRIPTION OF THE DRAWINGS

Operation of the thermal storage heat pipe of the present invention is explained by reference to the operation of the heat pipe under five conditions: (1) normal operation, (2) operation with no condenser heat rejection, (3) operation when evaporator cooling requirements exceed the condenser heat rejection capacity, (4) recharging the heat pipe storage system, and (5) startup.

The following table is an exemplary list of adsorbent material candidates for use in the present invention.

TABLE 1

| Adsorbent Material | |
|---|---|
| • molecular sieves | • alumina |
| • activated carbon | • metal oxides |
| • silica gel | • Fullers earth |
| • metal halide salts (used as ammoniates, e.g., ammonia with calcium chloride to form an ammonia/calcium chloride complex). | |

Figure 2:
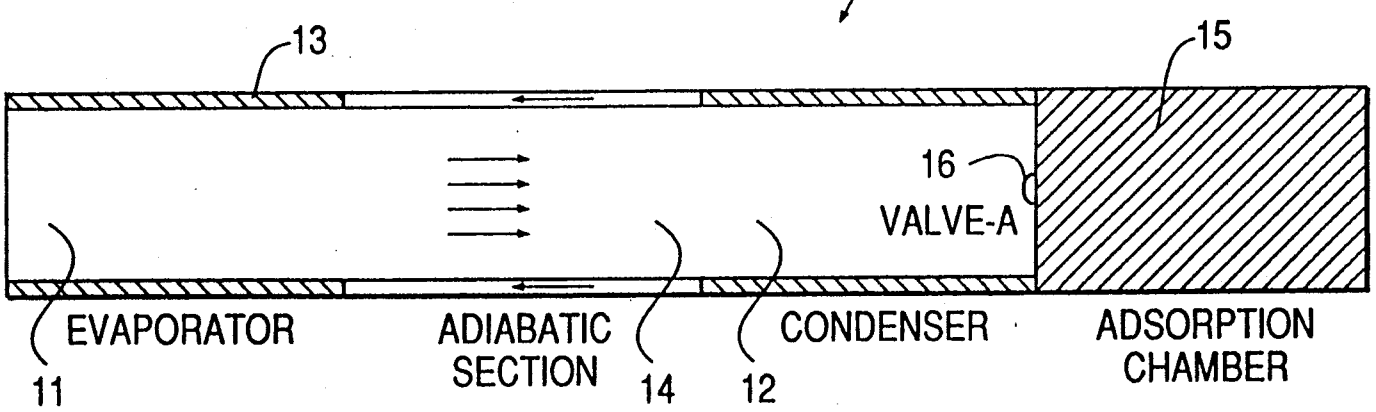
FIG. 2 is a schematic cross-sectional view of the heat pipe incorporating the principles of the present invention.

A heat pipe designated generally by the numeral 10 in FIG. 2 consists of an evaporator section 11, a condenser section 12 that uses a conventional wicking material 13 (grooves, screen, or sintered metal), an adiabatic section 14 (the liquid artery of which can be configured without wicking material to maximize the volume of liquid stored therein and to minimize pressure drop), and an adsorption chamber 15 connected to the condenser section 12 by a spring-loaded pressure-or bimetallic temperature-actuated valve 16. The adsorbent in the adsorption chamber 15 can be a molecular sieve, activated carbon, silica gel, alumina, Fullers earth, metal oxide, or metal halide salt (Table 1). If necessary, these adsorbents can be contained within a screen mesh.

The valve 16 is configured so that upon a temperature or pressure rise in the heat pipe 10, the valve 16 opens to allow flow into the adsorption chamber 15, and when the adsorption chamber pressure or temperature exceeds the heat pipe pressure, the valve 16 is also opened. There are numerous reliable commercially-available mechanical valves that can be used for this type of operation, including a spring-loaded pressure-actuated valve or a bi-metallic valve which distorts from a temperature rise to allow flow through the valve. Hence, the details of construction of the valve 16 per se will be dispersed with since they do not form part of the present invention.

(1) Normal System Operation

Under normal operation, the system behaves as an ordinary heat pipe. Liquid is vaporized in the evaporator section 11, flows down the vapor core, and condenses in the flooded condenser section 12 Liquid then returns to the evaporator section 11 via the liquid artery of the adiabatic section 14. The valve 16 to the adsorption chamber 15 is closed, and the adsorption bed in chamber 15 is unsaturated.

(2) Loss of Condenser Cooling Operation

For cases in which there is a cooling requirement by the evaporator section 11, i.e., vapor is generated at the evaporator section 11 but condenser heat rejection is unavailable, the present invention provides a system that continues to work. That is, the heat pipe 10 will use its thermal storage capability until the storage capacity is exhausted. For this case, the operation of the pipe 10 as follows:

(i) Normal operation, the valve 16 is closed. The pipe 10 is operating at the design temperature.

(ii) Now a loss of condenser cooling occurs for whatever reason. The condenser section 12 stops condensing vapor since it is not being cooled, so there is no way to supply the heat removal necessary to condense the vapor. For a conventional heat pipe, the temperature and pressure of the pipe, and therefore the temperature and pressure in the evaporator and condenser sections, would continue to rise until (a) a condenser temperature capable of rejecting the heat is attained., (b) the evaporator heat load decreases or stops due to the higher evaporator temperature, or (c) the pipe fails. This temperature excursion would either cause the component being cooled to fail or shorten its life since electronic life has been shown to be severely shortened by moderate temperature variations or high temperature. With the pipe of the present invention, however, the pressure and temperature of the pipe 10 will also rise, but at some relatively small preset-temperature/pressure rise, with the valve 16 opening to allow a flow of vapor into the adiabatic adsorption chamber 14. It will be readily understood that the precise, point of valve opening is a design variable depending upon system requirements. The heat pipe pressure and temperature will stabilize at this point until the thermal storage capability is no longer needed or the storage capacity is exhausted. If the storage capacity is exhausted, the heat pipe 10 can be configured so that the pressure/temperature behavior will once again follow the behavior of an ordinary heat pipe or it can be configured so that the evaporator section 11 and the condenser section 12 are thermally disconnected.

(iii) During the storage phase of the pipe's operation, vapor is still generated at the evaporator section 11, but instead of being condensed in the condenser section 12, the vapor flows through valve 16 into the adsorption chamber 15 where it is adsorbed. Additional liquid flows to the evaporator section 11 from the condenser structure and the liquid artery, which are both gradually depleted of liquid. As the condenser wick structure and liquid artery are depleted of liquid, this volume is filled by vapor from the vapor core. The vapor enters the liquid artery by flowing from the vapor space, through the condenser section 12, and into the liquid artery. Eventually either the adsorbent bed will become saturated with working fluid or the condenser section 12 and liquid artery will be depleted of liquid causing the evaporator section 11 to dry out. If the adsorbent bed becomes saturated, the thermal storage heat pipe 10 will nevertheless continue to function as an ordinary heat pipe. However, if the wick dries out, thermal storage or thermal transport is no longer available until condenser cooling is once again available. If condenser cooling becomes available, the pipe pressure will drop, causing the flow of working fluid from the adsorbent bed back into the pipe 10 and restarting the operation of the pipe 10. In this connection, see subtitle (4) below entitled "Recharging of the Heat Pipe Storage System", below.

The pipe 10 is configured so that the vapor generated from the liquid stored in the liquid artery, the condenser wick structure, and the evaporator wick structure is greater than or equal to the storage capacity of the adsorbent bed. The choice is determined by whether the heat pipe is to continue as a regular heat pipe or to thermally disconnect when the storage capacity is exhausted.

(3) Evaporator Load Exceeds Condenser Heat Rejection

When the evaporator cooling requirement exceeds the heat rejection capacity of the condenser section 12, the thermal storage of the present invention will continue in conjunction with the heat pipe's thermal transport of the heat energy from the evaporator section 11 to the condenser section 12. That is, the heat pipe 10 will use its thermal storage capability to store the excess evaporative load until the storage capacity is exhausted. The operation of the heat pipe 10 is a combination of the above-described "normal" and "loss of condenser heat rejection" cases:

1. In normal operation, the valve 16 is closed, and the pipe 10 is operating at the design temperature.

2. The vapor flow to the condenser section 12 exceeds vapor condensation capacity; in other words, evaporator cooling exceeds, for whatever reason, condenser heat rejection. For an ordinary heat pipe, the temperature and pressure of the pipe, and therefore the temperature and pressure in the evaporator and condenser, would continue to rise until a) a condenser temperature capable of rejecting the evaporative heat load is attained, b) the evaporator heat load decreases or stops due to the higher evaporator temperature, or c) the pipe fails. Again as in case (2) above, this temperature excursion would either cause the component being cooled to fail or substantially shorten its life.

For the heat pipe 10 of the present invention, however, the pressure and temperature of the pipe will also rise, but at some relatively small preset temperature or pressure rise, the valve 16 would open allowing flow of vapor into the adiabatic adsorption chamber 15. Once again, the heat pipe pressure and temperature will stabilize at this design point until the thermal storage capability is no longer needed or the storage capacity is exhausted. As stated in case (2) above, if the storage capacity is exhausted, the heat pipe can be configured so that the pressure/temperature behavior will once again follow the behavior of an ordinary heat pipe, or it can be configured so that the evaporator section 11 and condenser section 12 are thermally disconnected.

3. During the storage phase of the pipe's operation, vapor is still generated at the evaporator section 11, but instead of all of this vapor being condensed in the condenser section 12, the excess vapor flows through valve 16 into the adsorption chamber 15 where it is absorbed. Additional liquid flows to the evaporator section 11 from the condenser wick structure and the liquid artery, which are gradually depleted of liquid. Once the active condenser surface has been decreased to the point where it cannot accommodate the available condenser heat rejection, the condenser's temperature will drop, causing the pressure to drop and the adsorption chamber valve 16 to close. The heat pipe 10 will continue to operate in this configuration, and no additional thermal storage will be available unless condenser heat rejection capacity changes.

If additional condenser heat rejection capacity becomes available, the heat pipe temperature/pressure will drop, causing the valve 16 to open and resulting in a desorption of working fluid from the adsorption chamber 15 (i.e., working fluid will be added to the heat pipe from the adsorbent chamber 15). Alternately, if heat rejection capacity decreases, the heat pipe temperature/pressure will increase, causing the valve 16 to open and resulting once again in a flow of excess vapor through the valve 16 and into the adsorption chamber 15, where it is adsorbed. Once the active condenser surface is decreased to the point where it can just accommodate the condenser heat rejection, the pipe 10 will again begin to operate as an ordinary heat pipe, and no additional thermal storage will be available until condenser heat rejection capacity once again changes.

(4) Recharging of the Heat Pipe Storage System

To recharge the heat pipe storage system, namely a passive approach, and an electrically heated approach will be used.

Figure 1:
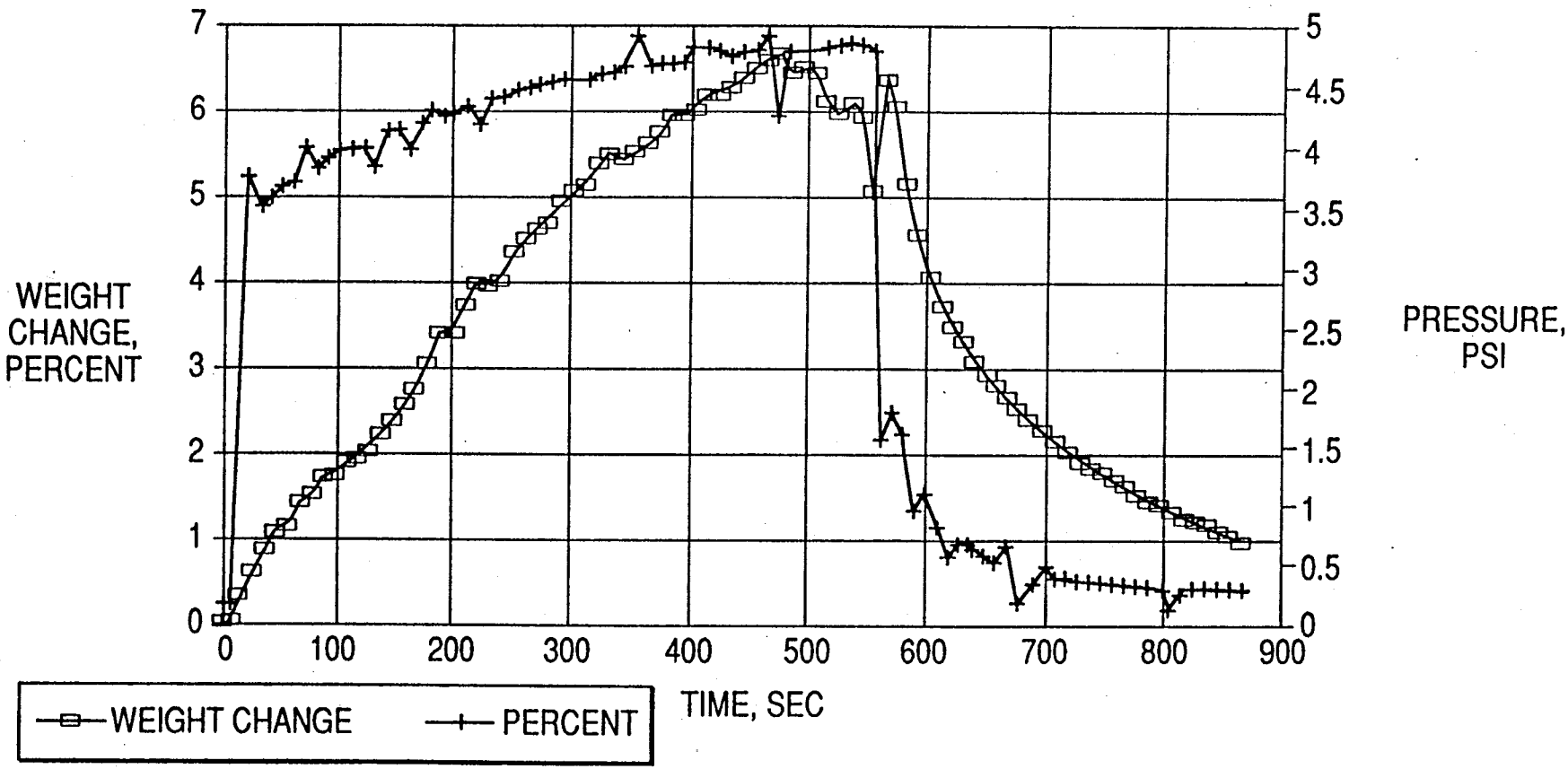
FIG. 1 is the graph previously described showing how rapidly the working fluid is adsorbed or desorbed from the adsorbent material.

The passive approach occurs naturally when the heat pipe cooling requirement (heat load at the evaporator 11) is less than the heat rejection capacity at the condenser section 12. In those cases, the pressure and temperature in the pipe 10 will decrease, and the adsorption chamber pressure will exceed the pipe pressure causing the valve 16 to open. The vapor will desorb off the bed and condense in the condenser 12. This adsorption process is endothermic, resulting in a cooling of the adiabatic bed, making further desorption slightly slower as indicated in FIG. 1.

The storage of the adsorbed bed can be recharged by electrically heating the bed. This electrically heated approach will allow for a greater mass of material to be adsorbed and desorbed from the bed, but it will also increase the heat rejection requirements and add electrical requirements during periods of thermal storage recharge. The desirability of the approach depends on the particular operational requirements and duty cycle of the spacecraft thermal control system.

(5) Frozen Heat Pipes and Frozen Start-Up

One problem with water heat pipes is the freezing of the pipe because the resulting expansion of the frozen water would destroy the pipe. The heat pipe could freeze during a non-use period because of the thermal radiation to space. To avoid this problem in conventional water heat pipes, the heat pipes are continually heated until they are used; the heat is used to keep the contained water from freezing. The heat pipe 10 of the present invention contemplates instead adsorbing the water working fluid on the adsorbent bed in the adsorption chamber 15. Then at some future time, when the heat pipe is needed, the electric heater in the adsorption chamber 15 is activated, driving the vapor off the bed and into the heat pipe 10 where it fills the vapor space, condenses in the condenser 12 and fill the liquid artery. The system then begins normal operation.

The thermal storage heat pipe of the present invention is also applicable to pipes that must undergo a "frozen start-up" from launch conditions. Instead of a frozen working fluid within the pipe however, the working fluid is stored in the adsorption chamber 15 during launch. To start the pipe, the adsorption chamber 15 is heated, causing the vapor generated to fill the vapor space, to condense in the condenser section 12 and then to fill the liquid artery. At this point, the system would begin normal operation.

By way of example to demonstrate the storage capability of the heat pipe of the present invention, storage calculations have been performed for a typical copper-water heat pipe, e.g., one meter long with an inner or vapor section diameter of 12 mm and a wick in the form of extruded grooves. The groove depth and width are each 0.8 mm, with 24 groves in the pipe. Thus the total grove volume is 15,600 $mm^3$. It is assumed that the fluid inventory is such to fill the entire groove volume.

For a 300K heat pipe, the available liquid from vaporization can be calculated from the liquid volume and the saturated liquid specific volume as 0.0155 Kg. This represents adsorption bed mass of 0.055 kg and bed volume of 4.3E−5 $m^3$. The thermal storage capability of this system is therefore 486 kJ/kg or 8.8E+5 kJ/$m^3$. As Table 2 below shows, this storage capability is much better than any other thermal storage material even if the mass and size of the storage containers required for these other configurations are neglected. In addition, the present design does not suffer from thermal cycling, solid-phase heat transfer, or solidification problems as do known devices.

TABLE 2

Thermal Storage of Various Materials

| Configuration | Energy Storage Per Unit Mass [kJ/kg] | Energy Storage Per Unit Volume [kJ/m3] |
|---|---|---|
| Proposed Cu-Water Thermal Storage Heat Pipe | 486 | 8.8 E + 5 |
| n-Heptadecane | 214 | 1.83 E + 5 |
| n-Octadecane | 244 | 1.87 E + 5 |
| Lithium Nitrate Trihydrate | 297 | 6.77 E + 5 |
| Calcium Chloride Hexahydrate | 167 | 2.86 E + 5 |
| Gallium | 80 | 4.73 E + 5 |
| Sodium Sulfate Decahydrate (Glauber's Salt) | 237 | 3.50 E + 5 |
| Metal Hydride $LaNi_{4.7}A10.3$ | 120 | 9.77 E + 5 |

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A thermal storage heat pipe, comprising
a working fluid,
an evaporator,
a condenser,
an adiabatic section operatively arranged between the evaporator and the condenser for the working fluid,
an adsorption chamber, and
means for connecting the adsorption chamber to the condenser in response to changes in at least one of pressure and temperature in the heat pipe.

2. The thermal storage heat pipe according to claim 1, wherein the condenser includes wicking material.

3. The thermal storage heat pipe according to claim 2, wherein the wicking material is one of grooves, a screen and sintered metal.

4. The thermal storage heat pipe according to claim 2, wherein the adiabatic section includes a liquid artery configured to maximize stored liquid volume and minimize pressure drop thereacross.

5. The thermal storage heat pipe according to claim 1, wherein the adiabatic section includes a liquid artery configured to maximize stored liquid volume and minimize pressure drop thereacross.

6. The thermal storage heat pipe according to claim 1, wherein the adsorption chamber contains an adsorbent material selected from the group consisting of a molecular sieve, activated carbon, silica gel, alumina, Fullers earth, metal oxide and metal halide salt.

7. The thermal storage heat pipe according to claim 6, wherein the adsorption chamber includes a screen mesh arranged to hold the adsorbent material.

8. The thermal storage heat pipe according to claim 1, wherein the working fluid is selected from the group consisting of water, ammonia, methanol, and other refrigerants.

9. The thermal storage heat pipe according to claim 8, wherein the adsorption chamber contains an adsorbent material selected from the group consisting of a molecular sieve, activated carbon, silica gel, alumina, Fullers earth, metal oxide and metal halide salt.

10. The thermal storage heat pipe according to claim 9, wherein the adsorption chamber includes a screen mesh arranged to hold the adsorbent material.

11. The thermal storage heat pipe according to claim 10, wherein the wicking material is one of grooves, a screen and sintered metal.

12. A thermal storage method, comprising the steps of (a) normally vaporizing a working fluid to effect cooling, cooling and condensing the vaporized working fluid and returning the condensed working fluid adiabatically to a location where it can again be vaporized, and (b) in response to a selected change in one of pressure and temperature when at least one of the steps of the working fluid n longer being condensed and working fluid still being evaporated adsorbing the vaporized working fluid to store thermal energy.

13. The thermal storage method according to claim 12, wherein the step of adsorbing includes adsorbing the working fluid between periods of evaporation and condensation to avoid freezing of the working fluid.

* * * * *